United States Patent [19]

Dattilo et al.

[11] Patent Number: 4,622,496

[45] Date of Patent: Nov. 11, 1986

[54] ENERGY EFFICIENT REACTANCE BALLAST WITH ELECTRONIC START CIRCUIT FOR THE OPERATION OF FLUORESCENT LAMPS OF VARIOUS WATTAGES AT STANDARD LEVELS OF LIGHT OUTPUT AS WELL AS AT INCREASED LEVELS OF LIGHT OUTPUT

[75] Inventors: Donald P. Dattilo, Louisville, Ky.; Michael S. Knippert, Grants Pass, Oreg.

[73] Assignee: Energy Technologies Corp., Grants Pass, Oreg.

[21] Appl. No.: 808,468

[22] Filed: Dec. 13, 1985

[51] Int. Cl.[4] ..... H05B 41/16

[52] U.S. Cl. ..... 315/283; 315/106; 315/284; 315/290

[58] Field of Search ..... 315/283, 106, 284, 290

[56] References Cited

U.S. PATENT DOCUMENTS

| | | | |
|---|---|---|---|
| Re. 31,146 | 2/1983 | Gyursanszky | 315/283 |
| 2,170,449 | 8/1939 | Edwards | 315/283 |
| 2,314,311 | 3/1943 | Karash | 315/96 |
| 2,458,277 | 1/1949 | Lark | 315/284 |
| 4,017,761 | 4/1977 | Woldring | 315/106 |
| 4,181,872 | 1/1980 | Chermin | 315/106 |
| 4,238,708 | 12/1980 | Kaned | 315/284 |

*Primary Examiner*—Harold Dixon

*Attorney, Agent, or Firm*—Diller, Ramik & Wight

[57] ABSTRACT

A ballast and control circuit for use with fluorescent lights. The circuit aids energy efficiency by removing heater current flow once the lamp has ignited. The circuit also uses time delayed inductive storage to allow delivery to the lamps of increased operating current without a concurrent increase in power utilization.

15 Claims, 3 Drawing Figures

ENERGY EFFICIENT REACTANCE BALLAST WITH ELECTRONIC START CIRCUIT FOR THE OPERATION OF FLUORESCENT LAMPS OF VARIOUS WATTAGES AT STANDARD LEVELS OF LIGHT OUTPUT AS WELL AS AT INCREASED LEVELS OF LIGHT OUTPUT

TECHNICAL FIELD

This invention relates generally to fluorescent lamp control circuits.

BACKGROUND OF THE INVENTION

Electric discharge lamps, such as fluorescent lamps, operate by applying an electric current through a gas such that at least some of the gas atoms become ionized. When enough atoms are ionized, the gas becomes an electric conductor and light radiation results.

Several circuits have been devised for starting and operating fluorescent lamps with the intent of conserving energy while maintaining correct lamp operation. The most successful methods thus far incorporate high frequency (20 KH to 30 KH) lamp excitation. Examples include U.S. Pat. No. 4,477,748 to Grubbs; U.S. Pat. No. 4,398,128 to Wollank; U.S. Pat. No. 4,251,752 to Stolz; U.S. Pat. No. 4,055,335 to Perper; U.S. Pat. No. 4,109,307 to Knoll; U.S. Pat. No. 4,329,627 to Holmes; U.S. Pat. No. 4,220,896 to Paice; U.S. Pat. Nos. 3,648,196 and 3,753,071 to Engel et al.; U.S. Pat. No. 3,890,537 to Park et al.; U.S. Pat. No. 3,710,177 to Ward; U.S. Pat. No. 3,701,925 to Nozawa et al.; U.S. Pat. No. 3,573,544 to Zonis and others.

Dimming the lamps by reducing the frequency of excitation within a high frequency circuit has been presented as another means of reducing the power requirements. Examples include U.S. Pat. Nos. 4,207,497 and 4,210,846 to Capewell et al.; U.S. Pat. No. 3,936,696 to Gray; U.S. Pat. No. 3,422,309 to Spira; and U.S. Pat. No, 3,514,668 to Johnson et al. High frequency excitation does reduce the amount of power consumed (approximately 11% to 25% depending upon the design used). High frequency designs, however, have not been well received by the industry or used in large quantities because of the high failure rates encountered. As an example, one recent high frequency design produced in quantities of several thousand yielded a failure rate so severe that the product was taken off the market by the manufacturer.

Further, all high frequency designs suffer from one or more of the following problems; they can be damaged by transient voltages from the incoming AC line; they generate R.F.I. (Radio Frequency Interference); they shorten lamp life by causing premature failure of the filaments inside many lamps; they produce frequency variations due to heating of the active power components used (SCR's, Triacs, transistors or FET's); they require many more components thereby increasing costs of production; and operation can vary from one unit to another due to sensitivity to variations in tolerances of the components used.

Because of the above problems, low frequency, core and coil ballast units have prevailed. Nevertheless, when the high frequency ballast were introduced, attention was focused on energy conservation within the lighting industry. The increased interest resulted in low frequency ballast designs that incorporated various means of reducing the amount of power consumed. This combination of events led to strong differences of opinion in the industry. On the one hand, the high frequency designs reduced operating cost as much as 25%, but they were not reliable enough to use in large quantities. On the other hand, the low frequency designs were reliable, but offered little energy savings. In the great majority of cases, minimizing the cost of production prevailed, with the low frequency core and coil designs being less expensive than the high frequency ballast.

Presently, the core and coil ballast account for approximately 98% of all ballast sales. In order to maintain this market share, the manufacturers of low frequency core and coil ballast have devised means of making their products more energy efficient. In almost every case, this invites turning off the heater current to the filaments of the lamp after the lamp has ignited.

Examples of this method are found in U.S. Pat. No. 4,399,391 to Hammer et al. using a SIDAC connected in a series circuit with the primary of the filament transformer and a capacitor. In Hammer's design, the voltage differential needed to make the SIDAC perform its switching function is derived directly from one of the lamp filaments and phase shifted through a capacitor. This method of switching could very easily result in unstable operation (lamp oscillations) due to the current differential realized through lamps connected in series. The problem would become more significant when different wattage lamps are used, since the current characteristics of 40 watt lamps are much different from 34 watt lamps.

U.S. Pat. No. 4,010,399 to Bessone et al. discloses a method of turning off the heater current (filament current) using independent circuits consisting of a Triac connected in parallel with a resistor divider. The Triac/resistor networks are then connected in series with each lamp filament (2 networks per lamp). Thermal switches have also been used to open the filament circuit inside the lamp after reaching a specified temperature. Examples of this method are found in U.S. Pat. No. 2,354,421 to Pennybacker; U.S. Pat. No. 2,462,335 to Reinhardt; and U.S. Pat. No. 4,097,779 to Latassa. The same method was also used within a ballast by locating a thermal switch next to the transformer core in U.S. Pat. No. 2,317,602 to Hall. A relay with two sets of contacts was used by Bessone in U.S. Pat. No. 4,146,820 and a magnetizable core (forming a relay type switch) was used by Raney in U.S. Pat. No. 2,330,312. magnetic reed switches were used by Latassa in U.S. Pat. No. 4,009,412 that were energized by the magnetic field generated around the transformer core. This method required that the reed switches be oriented in a specific direction and located, within critical tolerances, in that portion of the magnetic field with the highest gauss levels. In addition, the problems were compounded due to variations from one reed switch to another. As a result, this method was never used in high volume production. A less effective method was used by Sammis in U.S. Pat. No. 3,525,901 whereby the heater voltage was controlled rather than being turned completely off.

Turning heater current off does conserve energy during normal lamp operation, but the amount of energy saved is limited to the amount of current required to operate the filaments; usually 8% to 10%.

Several methods of starting fluorescent lamps have been tried to yield a means of reducing the amount of energy used during the start process. For example, U.S. Pat. No. 3,982,153 to Burdick et al. used a surge current to achieve a rapid warm-up of the heaters. U.S. Pat. No. 3,582,709 to Furui used an unignited lamp as a ballast component in the circuit. U.S. Pat. No. 4,145,638 to Kaneda used series start circuits that operated sequentially causing one lamp to ignite before the other. U.S. Pat. No. 2,697,801 to Hamilton used a thermal switch to operate a relay which controlled the amount of current going to the heaters. U.S. Pat. No. 3,866,088 to Kaneda used a backswing voltage generated by an oscillator. U.S. Pat. No. 3,720,861 to Kahanic used a time delay circuit comprised of a SCR that generated a transient spike voltage to the heaters. U.S. Pat. No. 3,588,592 to Brandstadter used a SCR to control the voltage to the heaters. U.S. Pat. No. 3,851,209 to Murakami et al. used a pulse generating circuit consisting of a pulse transformer and bi-directional diodes. U.S. Pat. No. 2,668,259 to Stutsman used gas discharge tubes within the circuit to start the fluorescent lamps. U.S. Pat. No. 4,053,813 to Kornrumpf used a transistorized inverter circuit to control the voltage by controlling the frequency of the applied power.

Presuming, however, that a fluorescent fixture will be switched on and off five times a day, that the start process takes three seconds from beginning to end, and that a normal day of operation is eight hours. The total amount of time that the start circuit is in operation over a one year period would then be 1.52 hours, or 0.05% of the total lamp operation time. When the amount of energy saved due to improved starting circuits is compared to the amount of energy consumed to operate the lamps, it seems apparent that improved starting methods contribute very little to the over-all energy efficiency of fluorescent ballast operation.

Other proposed methods of controlling the operation of fluorescent lamps will also affect the amount of energy used. U.S. Pat. No. 3,753,040 to Quenelle describes a strobing circuit using a Triac as the means of control. U.S. Pat. No. 3,449,629 to Wigert et al. uses a variable frequency oscillator circuit that can be controlled externally by heat or light sensors. Another example is found in U.S. Pat. No. 3,317,789 to Nuckolls which stabilizes lamp operation in response to variations in either heat or light. U.S. Pat. No. 3,611,021 to Wallace uses a feedback signal to reference comparator to achieve stabilization. Reversing the flow of current through fluorescent lamps have been thought to balance the light output. Examples of this method of control are found in U.S. Pat. No. 2,810,862 to Smith using a relay and U.S. Pat. No. 3,904,922 to Webb et al. using a SCR bridge circuit. The amount of flickering encountered with fluorescent lamps is controlled with parallel connected capacitors in U.S. Pat. No. 2,487,092 to Bird, while U.S. Pat. No. 2,588,858 to Lehmann solves the problem by connecting the lamps in phase relationships through multiple series connections.

With the exception of external control options, the stabilization of light output has been greatly improved through the use of more efficient coatings on the inside surfaces of the lamps. Many of the problems discussed above have now been completely eliminated through improved lamp technology.

As a result of changing markets within the lighting industry, two independent efforts are now in process. The manufacturers of high frequency ballast are directing their efforts toward reducing the price of their products while improving reliability and performance, and the manufacturers of the low frequency ballast are seeking to improve the energy efficiency of their products without increasing price. A need clearly exists for a ballast unit that offers the price and reliability of the low frequency units along with the energy efficiencies of the high frequency units.

DISCLOSURE OF THE INVENTION

This need and others are substantially met through provision of the ballast circuit disclosed herein. Objects of the invention are to provide energy efficient ballast circuits for starting and operating fluorescent lamps, of various wattages, at standard light output levels as well as at increased light output levels from a low frequency power source such as a 60 Hz source.

A particular object of the invention is to provide ballast circuits that reduce the amount of power required for operation while maintaining full light output from fluorescent lamps using an inductive current storage method.

Additional objects of this invention are to provide ballast circuits with improved operational characteristics such as: reduced lamp current crest factor; lower operating temperature; increased power factor; and more efficient lamp starting at various temperatures.

BRIEF DESCRIPTION OF THE DRAWINGS

Other objects and advantages will become apparent upon making a careful review of the following description, particularly when reviewed in conjunction with the drawings, wherein.

BEST MODE FOR CARRYING OUT THE INVENTION

Figure 1:
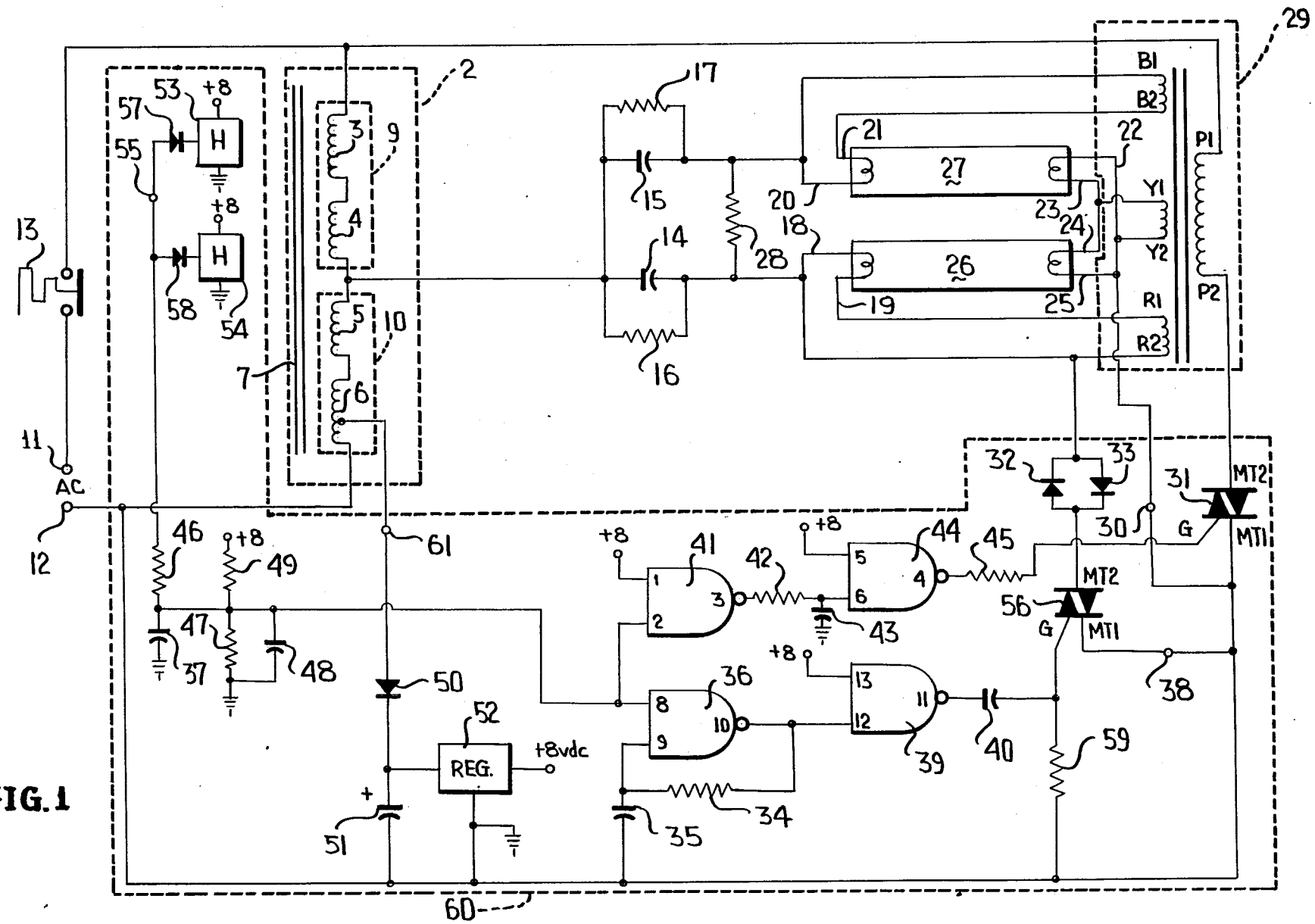
FIG. 1 is a schematic diagram of the ballast system showing one of the embodiments of the invention.

Referring now to the drawings and particularly to FIG. 1, one embodiment of the ballast apparatus can be seen as depicted generally by the numeral 1. The apparatus (1) includes an inductor assembly (2) that is comprised of four bobbin wound coils (3 through 6) assembled on an irregular shaped common core (7). Two of the coils (3 and 4) are serially connected to form a first coil grouping (9) and the remaining two coils (5 and 6) are serially connected to form a second coil grouping (10). Each coil grouping (9 or 10) can be individually considered as the electrical equivalent of one continuous coil wound on the irregular shaped common core (7). The two coil groupings (9 or 10) are serially connected at a common node (8) with the outermost ends of each coil grouping being connected to a 60 Hz power source by two terminals (11 and 12), with the outermost end of the first coil grouping (9) being serially connected through a thermal switch (13) to one terminal (11) and the outermost end of the second grouping (10) being directly connected to the remaining terminal (12). One terminal (11) is the hot side of the AC power source and the remaining terminal (12) is the neutral side of the AC power source.

When the inductor assembly (2) is connected to a source of 60 Hz AC power, it functions as an inductive current storage device that also regulates current flow with an efficiency dependent upon the interaction of the reactance of the coil grouping (9 and 10) in combination with the reluctance of the cross sectional area of the core (7). Since an inductor cannot release reactive power instantaneously, a short delay will occur between the coil groupings (9 and 10) that is dependent upon the vector sums of the reactive powers released from the coil groupings (9 and 10). The delayed response, or storage, of the inductive reactances provides the current regulation.

The inductor assembly (2) can be viewed as the electrical equivalent of the two coil groupings (9 and 10) wound on the irregular shaped core (7), with the first coil grouping (9) being the line inductor and the second coil grouping (10) being the load inductor. The significance of the second coil grouping (10) being connected in parallel with the output load sections of the apparatus (1) will be discussed in detail below.

The connection node (8) between the coil groupings (9 and 10) connects to two capacitors (14 and 15). One capacitor (14) also connects to one end of a first fluorescent lamp (26) through a wire (18). The other end of this lamp (26) connects to the neutral terminal (12) of the AC line through appropriate wires (25 and 30). In a like manner, the second capacitor (15) connects to a second lamp (27) through a wire (20) with the other end of the lamp (27) being connected to the neutral terminal (12) of the AC line through appropriate wires (22 and 30).

Since the capacitors (14 and 15) will pass AC current, the fluorescent lamps (26 and 27) are effectively connected in parallel between the common node (8) of the inductor assembly (2), and the neutral terminal (12) of the AC power source. Two resistors (16 and 17) are connected in parallel across the capacitors (14 and 15), respectively, to provide a means of discharging the capacitors (14 and 15) when the AC power source is deactivated in accordance with the safety requirements listed in Underwriters Laboratories safety standard number UL-935, seventh edition. Another resistor (28) is connected between the input to the lamps (26 and 27) through appropriate wires (18 and 20), respectively, to balance the current going to the lamps (26 and 27). (Since the resistance of a fluorescent lamp in operation is the effective resistance of the ignited gas within the lamp operating at a controlled current a fluorescent lamp is said to have a negative resistance.)

The above noted resistor (28) compensates for variations in negative resistance in different fluorescent lamps by causing the current going to the lamps (26 and 27) to be shared more evenly. The balancing of current going to the lamps (26 and 27) by this resistor (28) helps to reduce the crest factor of the lamps (26 and 27) during normal operation.

A filament transformer (29) is used to supply heater voltage to the filaments inside the lamps (26 and 27) as a necessary condition to start the lamps (26 and 27). The filament transformer (29) is comprised of one primary winding terminated at pins P1 and P2 and is wound on a common core with three secondary windings denoted as B1 and B2 for the first secondary, R1 and R2 for the second secondary, and Y1 and Y2 for the third secondary. The primary winding is connected to the hot side of the AC line by connection of pin P1 of the filament transformer (29) to one side of the thermal switch (13). The other end of the primary winding P2 is connected to terminal MT2 of a Triac (31) as explained below.

The first secondary of the filament transformer (29) connects to the lamp filament inside the second lamp (27) through appropriate wires (20 and 21), respectively. The second secondary connects to the lamp filament inside the first lamp (26) through appropriate wires (19 and 18), respectively. Finally, the third secondary connects to the lamp filaments inside both lamps (26 and 27) in parallel by connecting secondary Pin Y1 to the lamps (26 and 27) through a first set of wires (23 and 24), respectively and by connecting secondary Pin Y2 to the lamps (26 and 27) through a second set of wires (25 and 22,), respectively. The latter electrical point also connects to the neutral terminal (12) of the AC power source through a wire (30).

Certain start conditions must be met to cause the fluorescent lamps (26 and 27) to light when a source of 60 Hz AC power is applied to the terminals (11 and 12). The required start conditions are created by a start circuit denoted generally by the reference numeral 60.

The start circuit (60) is a digital circuit that operates from a +8 volt DC power source. The DC power source is derived from an AC voltage tap (61) located in one coil (6) of the second coil grouping (10). The output voltage of this tap (61) is 16 vac when measured between the tap (61) and the neutral terminal (12). The AC voltage at this tap (61) connects to the anode of a rectifier (50) that converts the AC voltage to half wave rectified DC. The cathode of this rectifier (50) connects to the input of an 8 volt positive voltage regulator (52) and also to the positive side of a capacitor (51). The negative side of this capacitor (51) and the negative terminal of the voltage regulator (52) are connected to the neutral terminal (12), which serves as both the neutral side of the AC power source and the ground side of the +8 vdc power supply. The capacitor (51) removes the ripple voltage coming through the rectifier (50) thus filtering the input voltage to the regulator (52). The output of the regulator (52) provides a regulated DC voltage of +8 vdc as the source of power to operate the start circuit (60).

The start circuit (60) is controlled by two Hall effect solid state magnetic switches (53 and 54) that are located at the end of the core (7) near the first coil grouping (9). Hall effect switches operate in a digital manner providing a low output in the presence of a south pole magnetic field and a high output in either a north pole magnetic field or no magnetic field at all.

Each logic gate used in the start circuit (60) appears individually (36, 39, 41 and 44), although all four gates may be physically contained in one component package. Each gate (36, 39, 41 and 44) comprises a digital C-MOS, 2 input, NAND, Schmitt trigger gate (Part #4093). Schmitt trigger gates produce a clean output signal when operating in an electrically noisy environment.

Each Hall effect switch (53 and 54) connects to the +8 vdc power source and to the neutral terminal (12). The output of the first Hall effect switch (53) connects to the cathode of a diode (57) and the output of the second Hall effect switch (54) connects to the cathode of a second diode (58). The anodes of these diodes (57 and 58) are connected together through a wire (55) and then serially connect through a resistor (46) to one side of a capacitor (37) and to pin 2 of one gate (41) and to pin 8 of another gate (36). The other side of the capacitor (37) connects to ground. A voltage divider consisting of two resistors (49 and 47) also connects to Pin 2 of the first gate (41) with the capacitor (48) being connected in parallel with a resistor (47). Pin 1 of this gate (41) connects to the +8 vdc to allow the gate (41) to function as an inverter. A capacitor (35) connects between ground and Pin 9 of the second gate (36) in combination with a resistor (34) that connects between Pins 9 and 10 of the second gate (36) to function as a 115 Hz oscillator that is controlled by Pin 8 of the second gate (36).

When a source of 60 Hz power is first applied to the terminals (11 and 12), only a small amount of power flows through the inductor assembly (2) which generates a magnetic field around the core (7) that is directly proportional to the amount of power flowing through the inductor assembly (2). Since the magnetic field is not yet strong enough to activate the Hall effect switches (53 and 54), their outputs are held high by the resistors (49 and 47) of the resistor divider network. The same high signal is applied to Pin 8 of the second gate (36) and Pin 2 of the first gate (41). As a result, Pin 3 of the first gate (41) goes low and transfers the low signal to Pin 6 of the third gate through a resistor (42). Pin 6 of the third gate (44) was already low prior to receiving a signal from the first gate (41) due to the time required to charge the capacitor (43) that connects between Pin 6 of the third gate (44) and ground.

The low signal created by the time period required to charge the capacitor (43), combined with the low signal being transferred from Pin 3 of the first gate, (41) guarantees that Pin 6 of the third gate (44) will be low the instant that AC power is applied to the terminals (11 and 12). When Pin 6 of the third gate (44) goes low, Pin 4 of this gate (44) will go high, causing a voltage to be applied to the gate terminal G of a Triac (31) through a resistor (45). The voltage applied to the gate terminal G causes the Triac (31) to switch on, which activates the filament transformer (29), thereby causing the filaments inside each lamp (26 and 27) to heat up. One second after the filaments inside the lamps (26 and 27) have been activated, an oscillator comprised of the second gate (36), a resistor (34), and a capacitor (35) begins to oscillate at the rate of 115 Hz. The delay before oscillation begins is due to the initial time period required to charge the capacitor (35). Pin 10 of the second gate (36) begins pulsing Pin 12 of the fourth gate (39) at a 115 Hz rate which causes Pin 11 of the fourth gate (39) to provide voltage pulses to the gate terminal G of the Triac (56) through a capacitor (40).

A resistor (59) connects between the gate terminal G of the Triac (56) and ground to discharge the capacitor (40) immediately after each positive pulse has passed through the capacitor (40). The Triac (56) is pulsed on and off by the positive pulses going to the gate terminal G. When the Triac (56) conducts, it temporarily shorts a capacitor (14) through two rectifiers (32 and 33), causing a controlled pulse voltage to be generated through a wire (18) to the hot side of the first lamp (26). Because the amplitude of the pulsed voltage is higher than the normal line voltage, the gas inside this lamp (26) responds by igniting during the negative transition of the pulse, which causes this lamp (26) to turn on. When this lamp (26) turns on, the negative resistance of the lamp (26) changes the load impedence which allows the voltage pulses to be coupled to the remaining lamp (27) through two capacitors (14 and 15), and to some extent through the sharing resistor (28) until the second lamp (27) switches on.

When both lamps switch on, the magnetic field created around the core (7) becomes strong enough to cause the Hall effect switches (53 and 54) to turn on and off at a 60 Hz rate. When the outputs of the Hall effect switches (53 and 54) go low (at a 60 Hz rate), the low pulses pass through two diodes (57 and 58) to an integrator network comprised of three resistors (46, 47 and 49) and two capacitors (37 and 48). The low pulses coming from the Hall effect switches (53 and 54) cause one capacitor (48) to discharge enough to lower the voltage going to Pin 8 of the second gate (36) and Pin 2 of the first gate (41) to a value that appears as a low signal, thereby reversing the start process which causes Pin 11 of the fourth gate (39) to go low and remain low as long as the Hall effect switches (53 and 54) continue to produce low pulses. It is important to note that the Triac (56) stops producing start pulses the instant that the Hall effect switches (53 and 54) sense that the lamps have turned on.

The same is not true of another Triac (31) which supplies power to the filament transformer (29). This Triac (31) remains on for one second after the first Triac (56) has turned off. This is due to the time period required for a capacitor (43) to discharge through a resistor (42) in response to the output signal from Pin 3 of the first gate (41). Pin 4 of the third gate (44) will go low when the capacitor (43) discharges, thereby turning Triac (31) off, which removes power to the filament transformer (29). Lamp filament power is allowed to continue for one second after the start pulses have stopped to assure that the lamps (26 and 27) remain on.

Immediately after the one second delay, the filament transformer (29) is turned off to conserve energy. The lamps (26 and 27) will continue to operate even though the power to the filaments inside the lamps (26 and 27) has been removed. The above description details only one of several means of producing time delays and switching functions using digital IC circuits, variations are possible without affecting the actual functions achieved, provided that solid state Hall effect switches are used to sense the change in the magnetic field when the lamps (26 and 27) turn on.

The ballast apparatus (1) may be made to accommodate 120 volt or 277 volt operation of either single lamp or dual lamp fixtures by simply adjusting the turns ratio of the first coil grouping (9) to the second coil grouping (10). Additionally, the amount of light output may be increased or decreased by increasing or decreasing respectively the values of the two coupling capacitors (14 and 15). Increasing the capacitance of these capacitors (14 and 15) will cause more current to be passed to the lamps (26 and 27). (In a single lamp configuration, one capacitor (15) one resistor (28) and one lamp (27) may be removed from the circuit). The ballast apparatus (1) will operate either 40 watt or 34 watt (energy saver) fluorescent lamps in any of the above configurations without any additional circuit changes.

The physical construction of the inductor assembly (2) may be modeled after an existing construction method. For specific details, reference is made to pending application Ser. No. 594,458 filed on Mar. 28, 1984 in the name of Gerald D. Boyd, as assigned to a common assignee. It is important to note that the physical construction (not the electrical or magnetic values or operation) may be incorporated in the construction of the inductor assembly (2). The sole purpose of using this particular construction method is to allow manufacture of an inductor assembly (2) in a small physical form. The ballast apparatus (1) will in fact, operate exactly the same when configured on separate and individual cores. It should be noted that the ballast apparatus (1) conserves energy in two ways. First, it removes the voltage going to the filaments inside the lamps (26 and 27) after they have turned on. Second, it provides more current to operate the lamps (26 and 27) than is currently available from 60 Hz ballast units.

Figure 2:
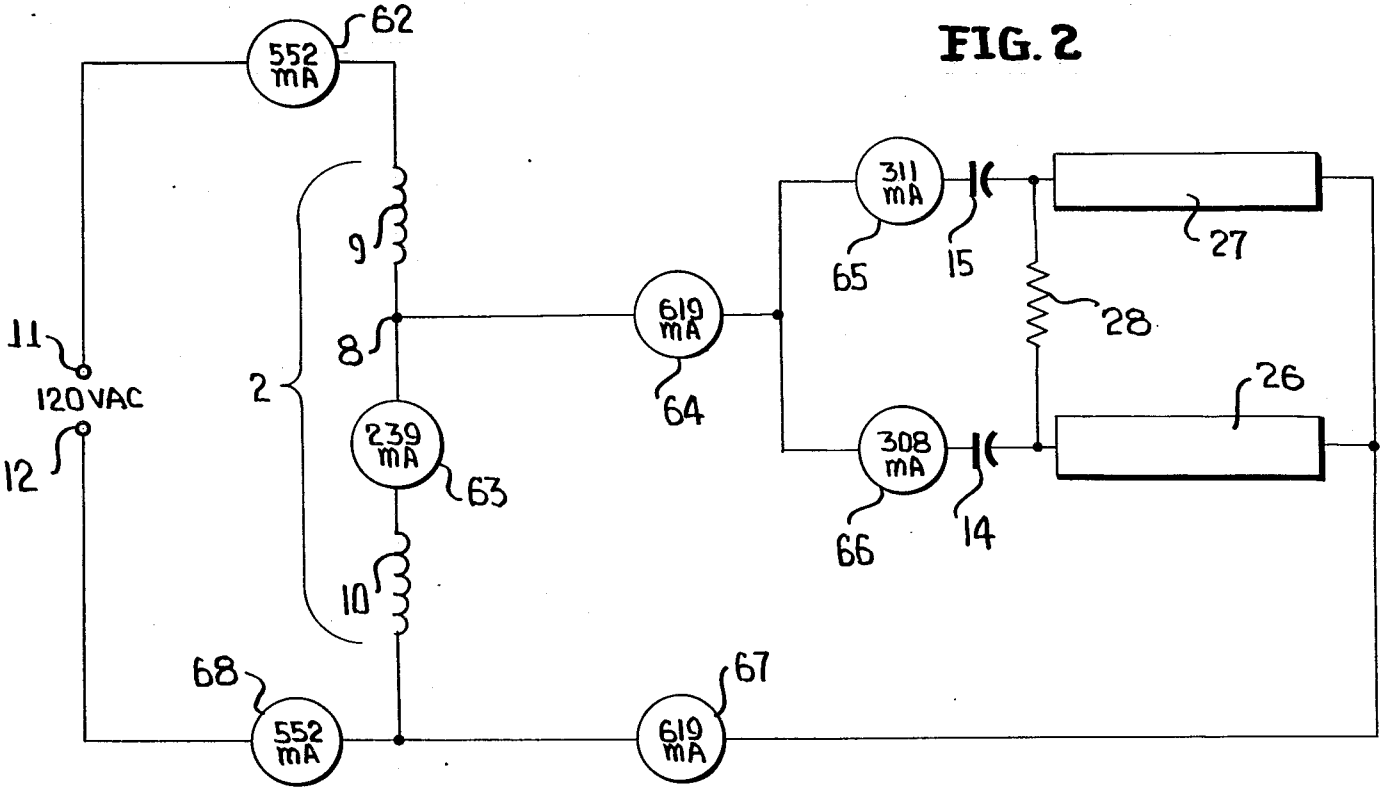
FIG. 2 is a schematic diagram of the ballast system with the start circuitry removed showing actual measured currents in various sections of the circuit during normal operation.
Figure 3:
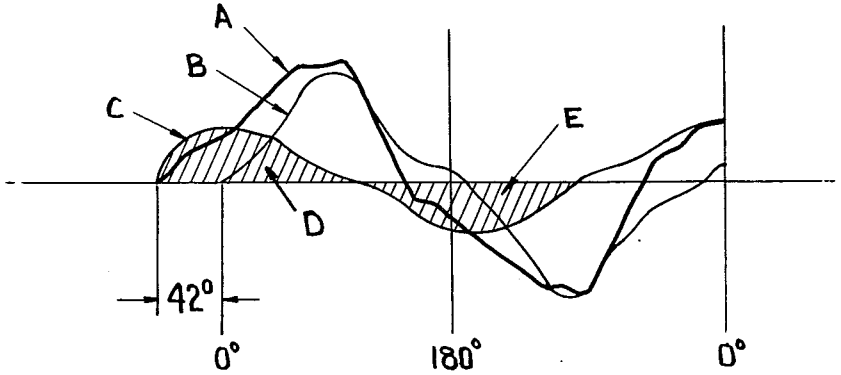
FIG. 3 is a waveform diagram showing the phase relationship of the stored reactive current.

Now, referring to FIGS. 2 and 3, the inductor assembly (2) can be seen as generally represented to include a line inductor (the first coil grouping (9)) and a load inductor (the second coil grouping (10)). Upon the application of the AC power to the inductor assembly (2) an inductive reactance is impressed upon the source impedence of the AC line that prevents the inductor assembly (2) from becoming a short circuit across the AC line voltage. In the example shown in FIG. 2, the inductance of the line inductor (9) is 398 mh and the inductance of the load inductor (10) is 1.51 h. Expressed in ratiometric terms, the load inductor (10) is 3.8 times more inductive than the line inductor (9). (Inductance is defined as the property of an electric circuit by virtue of which a varying current induces an electromotive force in that circuit or in a neighboring circuit.)

The inductive reactance of the load inductor (10) is converted to reactive power because the product of voltage and the out-of-phase component of alternating current is reactive power. In a passive network, reactive power represents the alternating exchange of stored energy (in this case inductive energy) between two areas. Expressed in simpler terms, the load inductor (10) releases power at a slower rate than the line inductor (9) because the load inductor (10) is 3.8 times more inductive than the line inductor (9). As a result of this difference in inductance, the current waveform of the load inductor (10), shown as waveform "C" in FIG. 3, is 138 degrees out-of-phase (lagging) from the waveform of the line inductor (9), shown as waveform "B". Or, expressed another way, waveform "C": is out-of-phase 42 degrees (leading) waveform "B".

The vector sum of waveform "B" plus waveform "C" equals waveform "A", which is the amount of current being delivered to the fluorescent lamps (26 and 27). Waveforms "D" and "E" represent the amount of energy stored (delayed) in the load inductor (10). By causing the energy stored in the load inductor (10) to be released in approximately the same phasing attitude as the energy in the line inductor (9) (only 42 degrees out-of-phase) the inductive power in the circuit is phase shifted to a point where it becomes usable power instead of being dissipated in the form of heat. As a result, the ballast apparatus (1) operates at a greatly reduced temperature of 34 degrees C. as compared to a standard ballast operating temperature of 90 degrees C. It thus becomes apparent that the ballast apparatus (1) takes advantage of stored inductive power within an alternating magnetic field in a much more efficient manner than has heretofore been done.

This method of storage could be defined as either "inductive storage" or "magnetic storage". Whichever term is used, the storage method can only occur in the presence of a circuit employing an alternating current with a changing magnetic field.

Referring again to FIG. 2, actual rms current measurements of the ballast apparatus (1) during normal operation for the embodiment described above is shown. A first meter (62) indicates that the system is drawing 552 ma from the incoming AC line. A second meter (63) indicates that the load inductor (10) has a circulating current of 239 ma. A third meter (64), however, indicates that 619 ma flows to the lamps (26 and 27). This meter (64) reflects the vector sum of the waveform currents "B" and "C" for a total of 619 ma which equals waveform "A". It is immportant to note that new power has not been created; rather, power already existing in the system has been phase shifted into a usable region of the AC waveform. Additional meters (65 and 66) indicate that the lamps (27 and 26) are drawing 311 ma and 308 ma, respectively. The difference between the current readings going to the lamps (26 and 27) is due to the difference in the negative resistance of each lamp. If the position of the lamps (26 and 27) were reversed, the respective current readings would follow. The sharing resistor (28) across the lamps (26 and 27) reduces the effects of the varying negative resistance within different lamps by causing the lamps (26 and 27) to share (or balance the load current more evenly.

The capacitors (14 and 15) couple the output of the inductor assembly (2) (at the common node 8) to the lamps (26 and 27). Increasing the value of these capacitors (14 and 15) allows more current to be coupled to the lamps (26 and 27) which will generally cause the lamps to increase in brightness. One embodiment of the ballast apparatus (1) can use this method to increase the amount of light output for the specific reason of compensating for a normal loss in light when used with fluorescent fixtures containing reflective materials that create multiple images of the lamps used.

The capacitors (14 and 15) also balance the phasing between the inductor assembly (2) and the lamps (26 and 27). At a point in time when the inductor assembly (2) is trying to release as much reactive power as possible, the capacitors (14 and 15) are trying to charge to their fullest potential. As a result, the inductor assembly (2) is pushing power out at the same point in time when the capacitors (14 and 15) are trying to pull power in. The total efficiency of the ballast apparatus (1) is dependent upon this relationship.

If the ballast apparatus (1) were allowed to establish a resonant frequency, a short circuit through the negative resistance of the lamps (26 and 27) would result. Since the capacitors (14 and 15) are between the inductor assembly (2) and the lamps (26 and 27) in a series circuit, a resonant circuit condition from either direction would cause damage to the lamps (26 and 27). The phase shift of waveform "C" combined with the appropriate values of the capacitors (14 and 15) assures that a resonant circuit condition is avoided.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What is claimed is:

1. A reactance ballast and control unit for use in connecting at least one electric discharge lamp having at least two filaments to a power source, said unit comprising:

(A) input means for connecting to said power source;

(B) output means for connecting to said at least one electric discharge lamp;

(C) heater means for supplying heater voltage to said at least two filaments;

(D) inductor means operably connected between said input means and said output means for providing operating current to said at least one electric discharge lamp; and (E) Hall effect switch means responsive to said inductor means for inhibiting said heater means from supplying heater voltage to said at least two filaments when sufficient current flows through said inductor means to create a sufficient magnetic field to switch said Hall effect switch means.

2. The unit of claim 1 wherein said Hall effect switch means includes two Hall effect switches positioned proximal to said inductor means.

3. The unit of claim 1 wherein said heater means includes transformer means for providing heater voltage of a substantially preselected value to at least one of said two filaments.

4. The unit of claim 3 wherein said heater means further includes gate means responsive to said Hall effect switch means for inhibiting said heater means.

5. The unit of claim 4 wherein said transformer means and said gate means are connected in series with said input means.

6. The unit of claim 1 wherein said inductor means includes:

(A) a line inductor having a first effective inductance and being operably connected between said input means and an inductor means output node;

(B) a load inductor having a second effective inductance and being operably connected between said input means and said inductor means output node, wherein said second effective inductance is at least two times the inductance of said first effective inductance;

and wherein said output means includes means for coupling said inductor means output node to said at least one electric discharge lamp.

7. The unit of claim 6 as used in connecting to at least first and second electric discharge lamps, wherein both of said lamps have a first filament that couples to said inductor means output node, and wherein said first filament for said first lamp connects to said first filament for said second lamp through a balancing resistor.

8. The unit of claim 6 as used in connecting to at least first and second electric discharge lamps, wherein said first lamp has a filament that couples to said inductor means output node through a first capacitor and said second lamp has a filament that couples to said inductor means output node through a second capacitor forming the electrical equivalent of parallel operation of the lamps if more than one lamp is used.

9. The unit of claim 1 and further including start means for initially igniting said electric discharge lamp, said start means including:

(A) at least one capacitor coupled between said inductor means and said output means;

(B) gate means for causing said capacitor to discharge and deliver a controlled voltage pulse to said lamp, said pulse having a higher voltage than said power source; and (C) oscillator means for causing said gate means to switch on and off, thereby providing a plurality of said controlled voltage pulses to said lamp to cause it to ignite.

10. The unit of claim 9 wherein said oscillator means is responsive to said Hall effect switch means, such that said oscillator means is inhibited from causing said gate means to switch when said Hall effect switch means inhibits said heater means.

11. A reactance ballast and control unit for use in connecting at least one electric discharge lamp having at least two filaments to a power source, said unit comprising:

(A) input means for connecting to said power source;

(B) inductor means for providing operating current to said at least one electric discharge lamp, wherein said inductor means includes:

(1) a line inductor having a first effective inductance and being operably connected between said input means and an inductor means output node; and (2) a load inductor having a second effective inductance and being operably connected between said input means and said inductor means output node, wherein said second effective inductance is at least two times the inductance of said first effective inductance;

(C) output means for coupling said inductor means output node to said at least one electric discharge lamp;

(D) at least first and second electric discharge lamps, both of said lamps have a first filament coupled to said inductor means output node, and said first filament for said first lamp connects to said first filament for said second lamp through a balancing resistor.

12. A reactance ballast and control unit for use in connecting at least one electric discharge lamp having at least two filaments to a power source, said unit comprising:

(A) input means for connecting to said power source;

(B) inductor means for providing operating current to said at least one electric discharge lamp, wherein said inductor means includes:

(1) a line inductor having a first effective inductance and being operably connected between said input means and an inductor means output node; and (2) a load inductor having a second effective inductance and being operably connected between said input means and said inductor means output node, wherein said second effective inductance is at least two times the inductance of said first effective inductance;

(C) output means for coupling said inductor means ouptut node to said at least one electric discharge lamp;

(D) at least first and second electric discharge lamps, said first lamp has a filament coupled to said inductor means output node through a first capacitor, and said second lamp has a filament coupled to said inductor means output node through a second capacitor forming the electrical equivalent of parallel operation of the lamps.

13. A reactance ballast and control unit for use in connecting at least one electric discharge lamp having at least two filaments to a power source, said unit comprising:

(A) input means for connecting to said power source;

(B) inductor means for providing operating current to said at least one electric discharge lamp, wherein said inductor means includes:

(1) a line inductor having a first effective inductance and being operably connected between said input means and an inductor means output node; and (2) a load inductor having a second effective inductance and being operably connected between said input means and said inductor means output node, wherein said second effective inductance is at least two times the inductance of said first effective inductance;

(C) output means for coupling said inductor means output node to said at least one electric discharge lamp;

(D) start means for initially igniting said electric discharge lamp, said start means including:

(E) at least one capacitor coupled between said inductor means and said output means;

(F) gate means for causing said capacitor to discharge and deliver a controlled voltage pulse to said lamp, said pulse having a higher voltage then said power source; and (G) oscillator means for causing said gate means to switch on and off, thereby providing a plurality of said controlled voltage pulses to said lamp to cause it to ignite.

14. A reactance ballast and control unit for use in connecting at least one electric discharge lamp having at least two filaments to a power source, said unit comprising:

(A) input means for connecting to said power source;

(B) output means for connecting to said at least one electric discharge lamp;

(C) heater means for supplying heater voltage to said at least two filaments;

(D) inductor means for providing operating current to said at least one electric discharge lamp, wherein said inductor means includes:

(1) a line inductor having a first effective inductance and being operably connected between said input means and an inductor means output node; and (2) a load inductor having a second effective inductance and being operably connected between said input means and said inductor means output node, wherein said second effective inductance is at least two times the inductance of said first effective inductance;

(E) output means for coupling said inductor means output node to said at least one electric discharge lamp; and (F) Hall effect switch means responsive to said inductor means for inhibiting said heater means from supplying heater voltage to said at least two filaments when sufficient current flows through said inductor means to create a sufficient magnetic field to switch said Hall effect switch means.

15. The unit of claim 14 further including at least one capacitor coupled between said inductor means and said output means such that an increase in capacitance of said capacitor will cause said at least on electric discharge lamp to glow brighter.

* * * * *